US011536520B2

(12) United States Patent
Thalappil et al.

(10) Patent No.: US 11,536,520 B2
(45) Date of Patent: Dec. 27, 2022

(54) MODIFIED SURFACE FOR CONDENSATION

(71) Applicant: INDIAN INSTITUTE OF TECHNOLOGY MADRAS (IIT MADRAS), Chennai (IN)

(72) Inventors: Pradeep Thalappil, Chennai (IN); Ankit Nagar, Chennai (IN); Ramesh Kumar, Chennai (IN); Srikrishnarka Pillalamarri, Chennai (IN)

(73) Assignee: INDIAN INSTITUTE OF TECHNOLOGY MADRAS (IIT MADRAS), Chennai (IN)

( * ) Notice: Subject to any disclaimer, the term of this patent is extended or adjusted under 35 U.S.C. 154(b) by 139 days.

(21) Appl. No.: 16/966,751

(22) PCT Filed: Feb. 2, 2019

(86) PCT No.: PCT/IN2019/050078
§ 371 (c)(1),
(2) Date: Jul. 31, 2020

(87) PCT Pub. No.: WO2019/150394
PCT Pub. Date: Aug. 8, 2019

(65) Prior Publication Data

US 2021/0041192 A1 Feb. 11, 2021

(30) Foreign Application Priority Data

Feb. 2, 2018 (IN) ..... 201741039127

(51) Int. Cl.
*F28F 13/18* (2006.01)
*C23F 1/30* (2006.01)
(Continued)

(52) U.S. Cl.
CPC ..... *F28F 13/187* (2013.01); *C23F 1/20* (2013.01); *C23F 1/30* (2013.01); *C23F 1/36* (2013.01);
(Continued)

(58) Field of Classification Search
CPC ..... C23F 1/20; C23F 1/30; C23F 1/36; F28D 2021/0063; F28F 13/187; F28F 2245/02; F28F 2245/04
See application file for complete search history.

(56) References Cited

U.S. PATENT DOCUMENTS

2006/0159916 A1* 7/2006 Dubrow ..... B01J 20/28007 428/401
2008/0241512 A1 10/2008 Boris et al.
(Continued)

FOREIGN PATENT DOCUMENTS

KR 10-1470287 12/2014

OTHER PUBLICATIONS

Zhang, Songnan et al. "Bioinspired Special Wettability Surfaces: From Fundamental Research to Water Harvesting Applications", Small, vol. 13, No. 3, Dec. 9, 2016 (Dec. 9, 2016)). (Year: 2016).*
(Continued)

*Primary Examiner* — Eric S Ruppert
*Assistant Examiner* — Hans R Weiland
(74) *Attorney, Agent, or Firm* — Wenderoth, Lind & Ponack, L.L.P.

(57) ABSTRACT

The present invention relates to a method of enhancing heat transfer of metallic surfaces by (1) fabricating hierarchical micro-nanostructured surfaces using etching processes, and (2) fabricating hydrophobic and hydrophilic regions, using a printing or a coating technique, followed by etching. The said method enhances the density of condensation sites over a metallic surface and additionally facilitates the departure
(Continued)

of condensed droplets from the surface. Such a surface also enhances the sensible heat transfer characteristics, and improves the coefficient of performance (COP) of refrigeration systems for applications like atmospheric water generators, dehumidifiers, air conditioners, etc.

8 Claims, 4 Drawing Sheets

(51) Int. Cl.
*C23F 1/20* (2006.01)
*C23F 1/36* (2006.01)
*F28D 21/00* (2006.01)

(52) U.S. Cl.
CPC .. *F28D 2021/0063* (2013.01); *F28F 2245/02* (2013.01); *F28F 2245/04* (2013.01)

(56) References Cited

U.S. PATENT DOCUMENTS

2011/0014432 A1* 1/2011 Terada ..... C23C 14/226 427/596
2012/0111549 A1* 5/2012 Fukuta ..... F28F 13/185 165/177
2013/0059123 A1 3/2013 Wang et al.
2014/0238645 A1 8/2014 Enright
2014/0272291 A1* 9/2014 Moon ..... C23F 4/00 204/192.12
2015/0048526 A1 2/2015 Kim et al.
2019/0330734 A1* 10/2019 Miljkovic ..... F28F 17/005
2020/0088481 A1* 3/2020 He ..... F28F 13/18

OTHER PUBLICATIONS

Anand, S. et al., "Enhanced Condensation on Lubricant-Impregnated Nanotextured Surfaces", ACS Nano, 2012, vol. 6, No. 11, pp. 10122-10129.
Wang, S. et al., "Bioinspired hierarchical copper oxide surfaces for rapid dropwise condensation", Journal of Materials Chemistry A, Accepted Manuscript, 2017, DOI: 10.1039/C7TA05087A, 8 pages.
Rykaczewski, K. et al., "Multimode Multidrop Serial Coalescence Effects during Condensation on Hierarchical Superhydrophobic Surfaces", Langmuir, 2013, vol. 29, pp. 881-891.
McCarthy, M. et al., "Materials, Fabrication, and Manufacturing of Micro/Nano-Structured Surfaces for Phase-Change Heat Transfer Enhancement", Nanoscale and Microscale Thermophysical Engineering, 2014, vol. 18, No. 3, 50 pages.
Cho, J.H. et al., "Nanoengineered materials for liquid-vapour phase-change heat transfer", Nature Reviews Materials, vol. 2, article No. 16092, pp. 1-17.

* cited by examiner

MODIFIED SURFACE FOR CONDENSATION

FIELD OF THE INVENTION

The present invention relates to a method of creating a modified surface for condensation. More specifically, it relates to the fabrication of hierarchical micro-nanostructures with/without local wettability gradients, over metal, prepared by etching and/or patterning processes in order to improve the efficiency of condensation heat transfer. Further, hierarchical structures, with/without wettability gradients also improve the sensible heat transfer.

BACKGROUND OF THE INVENTION

Heat transfer plays a crucial role in heating and air conditioning industries. Phase change is essential to energy applications, where it drastically enhances heat transfer because latent heat is typically much larger than sensible heat. Researchers have demonstrated the ability to enhance phase change heat transfer across surfaces by surface engineering at micro- and nano-length scales.

The present invention relates to a method of creating a modified surface for energy-efficient condensation. It also offers an additional advantage of improving the sensible heat transfer.

SUMMARY OF THE INVENTION

The present invention relates to a method of creating a modified surface for condensation. More specifically, relates to a modified surface for condensation, wherein the said surface comprises of scalable hierarchical micro-nanostructures includes aluminium surface which consist of scalable hierarchical $AlOOH/Al_2O_3$micro-nanostructures and hydrophobic-hydrophilic patterned regions for increasing the rate of condensation of fog, humidity and water vapor. The fabrication of hierarchical micro-nanostructures over a metallic surface, preferably copper, more preferably aluminum, prepared by etching process in order to improve its efficiency of condensation, preferably of atmospheric water.

In one embodiment, the present invention relates to a method of fabricating hierarchical micro-nanostructures using an etching process which creates large number of such droplet nucleation sites across the surface, resulting in an enhanced rate of condensation. The hierarchical structures comprise of micron-cones of height ranging from 10-20 μm, covered with nanoscale bumps of nearly 500 nm height. For the etching process, mild basic medium including dilute NaOH, KOH etc. is used or a mildly acidic medium of dilute $FeCl_3$, $H_2O_2$, HF, HCl, etc. is used.

In other embodiment, the present invention relates to a method of fabricating hydrophobic and hydrophilic regions by printing or coating an etch-resistant hydrophobic ink on the metal surface and etching the non-printed regions using acidic and/or basic medium to render them hydrophilic. Creating such patterns enables localization of micro-nanostructures to specific regions, which improves the rate of departure of condensed droplets from the surface, thus improving the overall rate of water collection.

The modified surfaces also improve sensible heat transfer between metallic surfaces and ambient air, thus improving heat transfer characteristics of heat exchangers and coefficient of performance (COP) of corresponding refrigeration systems, dehumidifiers, air conditioners, cooling towers, or preferably atmospheric water generators.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale; some features may be exaggerated to show details of particular components. Therefore, specific structural and functional details disclosed herein are not to be interpreted as limiting, but merely as a basis for the claims and as a representative basis for teaching one skilled in the art to variously employ the present invention.

The present invention relates to a method of creating a modified surface for condensation. More specifically, relates to a modified surface for condensation, wherein the said surface comprises of scalable hierarchical micro-nanostructures includes aluminium surface which consist of scalable hierarchical $AlOOH/Al_2O_3$micro-nanostructures and hydrophobic-hydrophilic patterned regions for increasing the rate of condensation of fog, humidity and water vapor.

The present invention relates to a method of fabricating hierarchical micro-nanostructures on metal surface using an etching process which enhances the number of condensation sites over a surface, improving the rate of condensation of humidity. The hierarchically-structured surface comprises of micron-sized conical structures of height nearly in the range of 10-20 μm, entirely covered by nano-scale bumps of nearly 500 nm height. Hierarchical micro-nanostructure also generate turbulence in air stream, which increases sensible heat transfer of the heat exchanger coil. For etching process, mild basic medium such as dilute NaOH, KOH etc. or a mild acidic medium such as $FeCl_3$, $H_2O_2$, HF, HCl, etc. is used.

The method of fabricating hydrophobic and hydrophilic regions includes printing or coating of an etch-resistant hydrophobic ink on the metal surface and etching the non-printed regions using acidic and/or basic medium to render them hydrophilic. The superhydrophobic area will facilitate the departure of condensed droplets from the surface. The etch-resistant hydrophobic ink is coated on the metal surface preferably by spray coating or screen printing. Wherein, etch-resistant hydrophobic ink is a thermally conducting carbon-based ink, preferably graphite/graphene based ink.

Figure 1:
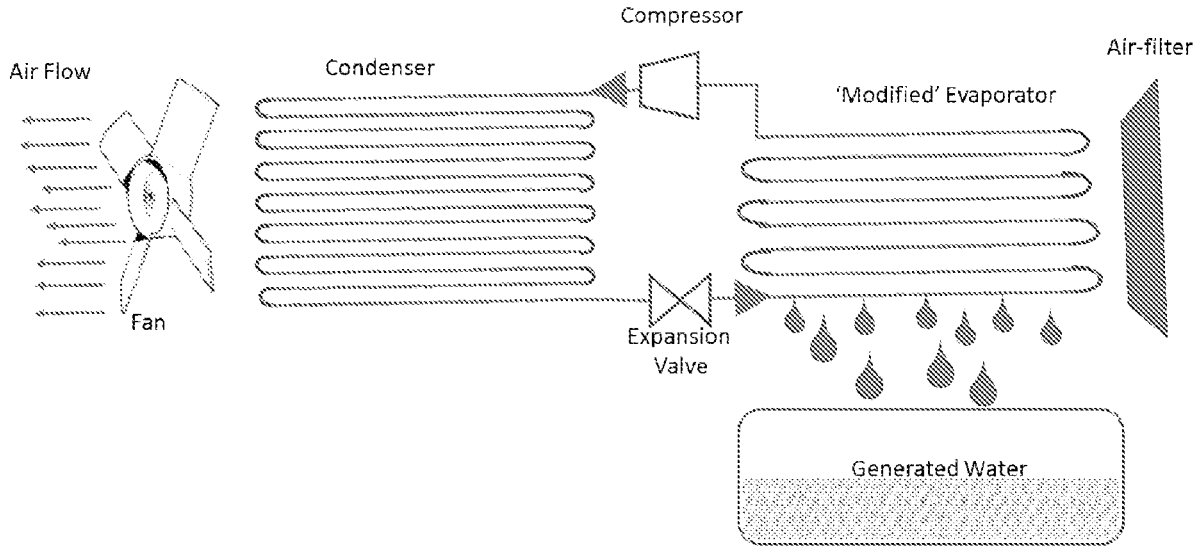
FIG. 1 Schematic of an atmospheric water generator. Ambient air enters the system by passing through an air-filter (extreme right) and then passes across the 'modified' evaporator having fins with hierarchical micro-nanostructures, over which condensation takes place. Cold air after the evaporator then passes across the hot condenser and leaves the system thereafter.

The modified surface with enhanced rate of condensation was tested against a commercial heat exchanger coil for heat transfer characteristics. The test setup design was same as the atmospheric water generator design, shown in FIG. 1. FIG. 1 shows that an atmospheric water generator where an ambient air enters the system by passing through an air-filter (extreme right) and then across the 'modified' evaporator having micro-nanostructured fin surfaces over which condensation takes place. Cold air after the evaporator then passes across the hot condenser and leaves the system thereafter. Modified heat exchanger coil reflected in a 2-14.5% improvement in the coefficient of performance (COP) of there frigeration system, compared to the same system with a standard heat exchanger coil.

Figure 2:
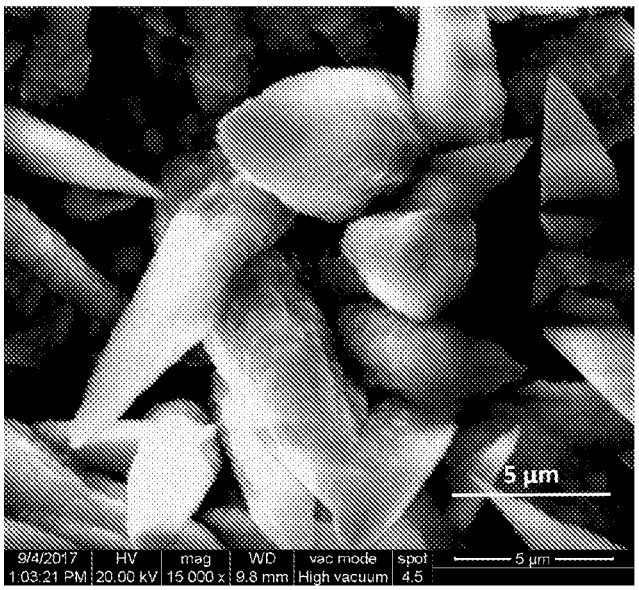
FIG. 2 SEM image of the aluminium fin surface, on which hierarchical micro-nanostructures were created by mild etching process. The micro-cones are covered with nano-bumps. These structures were reproduced on the surface of evaporator and condenser fins.

Hierarchical micro-nanostructures comprise of micron-sized cones, covered by nano-bumps (FIG. 2). Hierarchical micro-nanostructures created over the aluminium surface by mild etching process. The micro-cones are covered with nano-bumps. These structures were reproduced on the surface of evaporator and condenser fins. The presence of these micro-cones drastically enhances the number of nucleation sites onto a metal surface, and the nanostructured bumps allow the nucleated droplets to grow and enter into a Cassie-Baxter or a partial-wetting state, thus preventing strong adhesion to the surface. This enables coalescence and movement of the droplets over the surface and prevents flooding of droplets over the entire surface at high condensation rates, thus preventing film formation, which can act as a barrier to any further condensation, resulting in poor rate of condensation.

Performance of the surface have been tested to verify the following characteristics 1. Improvement in rate of condensation, and subsequently water collection because of micro-nanostructures (Table 1), 2. Further improvement in rate of condensation by introducing wettability gradients combined with micro-nanostructures (Table 2).

3. Improvement in COP of the refrigeration cycle with 'modified' evaporator and energy-efficient water collection from such a system (Table 3).

4. Improvement in sensible heat transfer at the condenser side due to hierarchical micro-nanostructures present on the surface of the fins (Table 4)

Test 1 Water collection performance comparison of flat aluminum surface against a modified micro-nanostructured aluminum surface (surfaces tested at evaporator-scale)

As shown in table 1, compared to a flat aluminum surface, micro-nanostructured surface showed a 30%-35% improvement in water collection performance under similar ambient conditions (at ~26 C dew point).

TABLE 1

Performance comparison of modified evaporator and a commercial evaporator from a 100-liter per day atmospheric water generator machine, under similar ambient conditions

| S. No | Temp (° C.) | % RH | DPT (° C.) | Runtime (hours) | Water Collection (liters) | Liters/Day (LPD) |
|---|---|---|---|---|---|---|
| Commercial Evaporator Performance | | | | | | |
| 1 | 28.0 | 92 | 26.6 | 11.3 | 49.3 | 104.7 |
| 2 | 30.5 | 78 | 26.2 | 9.3 | 35.7 | 92.0 |
| Modified Evaporator Performance | | | | | | |
| 3 | 29.4 | 82 | 26 | 2 | 10.6 | 127.2 |
| 4 | 29.2 | 81 | 25.6 | 12.4 | 66.8 | 129.3 |

The above results in table 1 demonstrate the capability of micro-nanostructures in enhancing the water collection performance of a flat metal surface. Such structures created over an evaporator, will boost the performance of a dehumidifier, an air conditioner and an atmospheric water generator by improving condensation heat transfer. This will reduce the operating costs and improve the operational power efficiency of an atmospheric water generator by 15-30%.

Test 2: Water collection performance comparison between micro-nanostructured surface and the patterned surface with localized micro-nanostructures combined with wettability gradients (surface area=16 $cm^2$)

Figure 3:
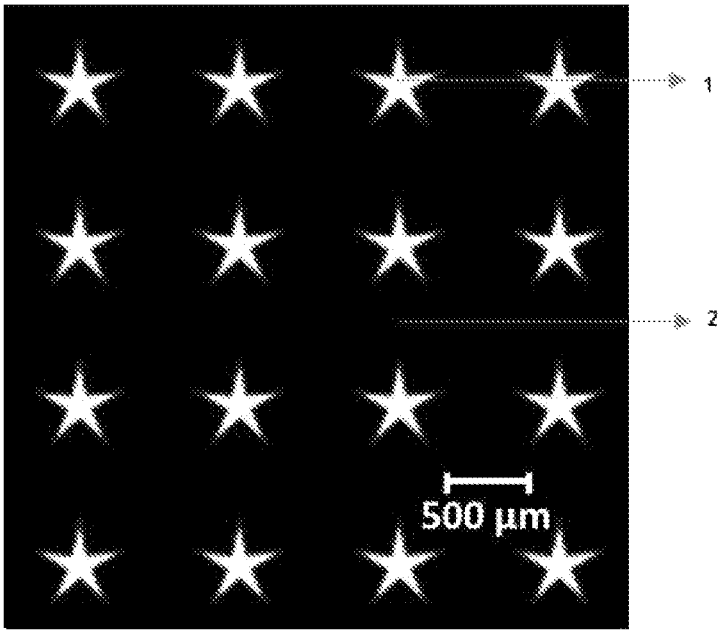
FIG. 3 Schematic representation of a hydrophobic-hydrophilic patterned metal surface using screen printing followed by etching. The black region is a screen-printed etch-resistant hydrophobic coating (2) Etching performed after printing renders star-shaped regions hydrophilic due to creation of hierarchical micro-nanostructures (1) and the remaining un-etched region hydrophobic. The scale indicated in the figure is approximate, and may vary, depending upon the coating.
Figure 4:
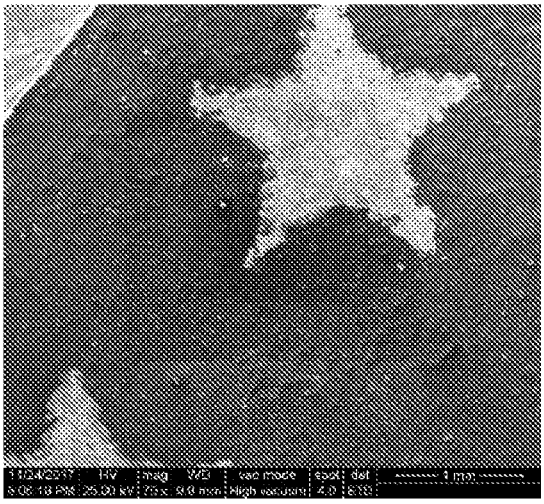
FIG. 4 SEM image of hydrophobic-hydrophilic patterned surface with micro-nano structures Referring to the drawings, the embodiments of the present invention are further described. The figures are not necessarily drawn to scale, and in some instances the drawings have been exaggerated or simplified for illustrative purposes only. One of ordinary skill in the art may appreciate the many possible applications and variations of the present invention based on the following examples of possible embodiments of the present invention.

In order to further improve the water collection, the droplets were forced to move over the surface at much smaller sizes, at which gravity has an insignificant contribution. This was achieved by patterning the surface into hydrophobic and hydrophilic regions, as shown in FIG. 3. FIG. 3 illustrates hydrophobic-hydrophilic patterned surface with micro-nano structures within the star-shaped regions. Fabrication process involves creating star-patterns by printing or coating, followed by etching within the star-shaped regions. These structures further increase the rate of water transport away from the surface. These patterns drive water droplets to move spontaneously towards the hydrophilic regions due to the wettability gradients. Subsequently, droplet coalescence occurs in the hydrophilic regions until they are saturated, and gravity causes this locally collected water to drip down from the surface. For this, a screen-printable hydrophobic graphite/graphene coating was used, to create a negative of an array of star-shaped patterns with bare metal surface.

Hydrophobic-hydrophilic patterned surface with micro-nano structures, prepared from the above method, was maintained at a constant temperature below the dew point, and tested for water collection against the etched surface shown in FIG. 2. Table 2 compares the water generation performances of surfaces prepared from both the methods.

TABLE 2

Comparison of water generation performance of micro-nano structured metal surface (S1) versus a hydrophobic-hydrophilic patterned surface with micro-nano structure (S2)

| Surface | | Surface Area ($cm^2$) | Cooling method | Heat transfer on hot side | Power input to peltier (W) | Ambient conditions | Water Collected Vol. (ml) | Water Collected Time (h) | Water Collected ($LPD/m^2$) |
|---|---|---|---|---|---|---|---|---|---|
| S1 | Test 1 | 16 | Peltier module (4 cm × 4 cm) $T_h = T_a$, $T_c = 8.0°$ C. | 12 V DC fan | 5.88 W (3.92 V, 1.50 A) | 24.0° C., 70% RH | 13.34 | 16.6 | 12.04 |
| S2 | | 16 | Peltier module (4 cm × 4 cm) $T_h = T_a$, $T_c = 8.0°$ C. | 12 V DC fan | 7.17 W (4.0 V, 1.77 A) | | 17.05 | 16.6 | 15.4 |
| S1 | Test 2 | 16 | Peltier module (4 cm × 4 cm) $T_h = T_a$, $T_c = 8.0°$ C. | 12 V DC fan | 5.88 W (3.92 V, 1.50 A) | 24.5° C., 78% RH | 20.9 | 24.0 | 13.1 |
| S2 | | 16 | Peltier module (4 cm × 4 cm) $T_h = T_a$, $T_c = 8.0°$ C. | 12 V DC fan | 7.17 W (4.0 V, 1.77A) | | 27.8 | 24.0 | 17.4 |

It is therefore conclusive from table 2 that a patterned and subsequently etched surface provides nearly 1.15-1.30 times higher water collection performance than a hierarchical micro-nanostructured surface.

Test 3: Effect of micro-nanostructures on the Coefficient of Performance (CoP) and energy efficiency of collected water for refrigeration systems by reproducing these structures on the evaporator and condenser A more accurate comparison as well as impact of micro-nanostructures on refrigeration-based AWG machines is evident from Table 3 where heat exchanger-scale surfaces are compared against power efficiency (kWh/liter) and refrigeration system efficiency of the AWG machine. Both surfaces were tested with same refrigeration system, not necessarily optimized to best performance, but under same ambient conditions.

TABLE 3

Performance comparison between commercial evaporator (Normal) and modified evaporator (modified) with hierarchical micro-nanostructures, in terms of refrigeration system's Coefficient of Performance (CoP) and energy efficiency of an atmospheric water generator. 'Normal' indicates un-modified coil with flat fins, while 'Modified' indicates coil with micro-nanostructured fins

| S. No | Date | Ambient T | Ambient RH | Evaporator used | Condenser used | COP | kWh/ltrs |
|---|---|---|---|---|---|---|---|
| 1 | 24 Jul. 2018 | 36 | 39 | Modified | Normal | 3.881 | 0.625 |
| | 11 Jun. 2018 | 36 | 39 | Normal | Normal | 3.769 | 0.737 |
| 2 | 24 Jul. 2018 | 31 | 70 | Modified | Normal | 3.455 | 0.438 |
| | 23 Jun. 2018 | 31 | 70 | Normal | Normal | 3.383 | 0.526 |
| 3 | 26 Jan. 2019 | 31 | 64 | Modified | Modified | 5.704 | 0.482 |
| | 29 Jan. 2019 | 31 | 69 | Normal | Modified | 5.593 | 0.550 |

Test 4: Heat transfer performance of a normal condenser tested against a modified condenser having same micro-nanostructures as the evaporator.

TABLE 4

Increase in sub-coolingfrom modified condenser coil

| Types of coils used | S. No | Ambient Temp ° C. | Ambient RH % | Pressure Discharge Psig | Temperature Tcond out ° C. | Temperature Tsat ° C. | Temperature Degree of sub-cooling ° C. |
|---|---|---|---|---|---|---|---|
| Modified Condenser | 1 | 28 | 71 | 265 | 40 | 44.02 | 4.02 |
| | 2 | 29 | 68 | 260 | 39.2 | 43.27 | 4.07 |
| | 3 | 31 | 62 | 270 | 40.7 | 44.77 | 4.07 |
| Normal Condenser | 1 | 28 | 72 | 262 | 42.6 | 43.57 | 0.97 |
| | 2 | 29 | 72 | 260 | 42.8 | 43.27 | 0.47 |
| | 3 | 31 | 69 | 269 | 44 | 44.62 | 0.62 |

Table 4 shows increase in sub-cooling of a standard condenser coil when it is modified to have micro-nanostructures. By modifying heat exchanger/condenser coil, sub-cooling increases to 4° C., against a 1° C. for a standard heat exchanger/condenser coil at similar ambient and refrigeration conditions. This further reduces suction to discharge pressure ratio for the compressor, thereby reducing the operational power consumption. Hence improvement in sub-cooling and super-heating of condenser and evaporator coils, respectively, are observed because of the hierarchical micro-nanostructures created over the fin surfaces of the coils.

It may be appreciated by those skilled in the art that the drawings, examples and detailed description herein are to be regarded in an illustrative rather than a restrictive manner.

We claim:

1. A modified metal surface for condensation of fog, humidity and water vapor comprising a metal and scalable hierarchical micro-nanostructures, wherein said metal is aluminium and said scalable hierarchical micro-nanostructures are made of $AlOOH/Al_2O_3$, wherein said modified metal surface contains hydrophilic-hydrophobic patterned regions created by a coating technique or a printing technique selected from spray coating and screen printing, wherein said scalable hierarchical micro-nano structures are prepared by an etching process, and wherein said scalable hierarchical micro-nano structures are etched onto a coated or printed surface formed by the coating technique or the printing technique, to regulate a condensation process.

2. The modified metal surface as claimed in claim 1, wherein the scalable hierarchical $AlOOH/Al_2O_3$ micro-nanostructures comprise micron-sized cones with nanostructured bumps, as nucleation sites for droplets.

3. The modified metal surface as claimed in claim 1, wherein the scalable hierarchical $AlOOH/Al_2O_3$ micro-nanostructures comprise micron-sized conical structures of 10-20 μm in height, the micron-sized conical structures being completely covered with nano-bumps of 500 nm in height.

4. The modified metal surface as claimed in claim 1, wherein the modified metal surface is etched in a mild basic medium selected from the group consisting of dilute NaOH and KOH, or is etched in a mild acidic medium selected from the group consisting of dilute $FeCl_3$, atmospheric $H_2O_2$, HF, and HCl.

5. The modified metal surface as claimed in claim 1, wherein the modified metal surface is etched using an etching process involving soft chemistry using a solution selected from the group consisting of glucose, sugars and amino acids.

6. The modified metal surface as claimed in claim 1, wherein ink used in said printing or coating technique is a graphenic/graphitic ink which is etch-resistant, hydrophobic, thermally conducting, and coatable or printable on a metallic surface.

7. The modified metal surface as claimed in claim 1, wherein the modified metal surface improves heat transfer efficiency of heat exchanger coils for applications in heating, air conditioning and is capable of being used for condensation and water collection for atmospheric water generators.

8. The modified metal surface as claimed in claim 1, wherein the coating technique is spray coating and the printing technique is screen printing.

* * * * *